United States Patent [19]

Pühringer

[11] 4,122,888

[45] Oct. 31, 1978

[54] METHOD OF GUIDING A CAST STRAND AND ARRANGEMENT FOR CARRYING OUT THE METHOD

[75] Inventor: Othmar Pühringer, Linz, Austria

[73] Assignee: Vereinigte Österreichische Eisen- und Stahlwerke - Alpine Montan Aktiengesellschaft, Linz, Austria

[21] Appl. No.: 680,752

[22] Filed: Apr. 27, 1976

[30] Foreign Application Priority Data

Apr. 30, 1975 [AT] Austria ..... 3321/75

[51] Int. Cl.[2] ..... B22D 11/128

[52] U.S. Cl. ..... 164/82; 164/448

[58] Field of Search ..... 164/82, 131, 282

[56] References Cited

U.S. PATENT DOCUMENTS

| | | | |
|---|---|---|---|
| B 396,916 | 3/1976 | Bode, Jr. et al. | 164/282 |
| 3,375,864 | 4/1968 | Butkevich et al. | 164/282 |
| 3,608,620 | 9/1971 | Bollig et al. | 164/282 X |
| 3,707,180 | 12/1972 | Vogt | 164/82 |
| 3,722,576 | 3/1973 | Gollver | 164/282 |
| 3,735,848 | 5/1973 | Bode, Jr. et al. | 164/282 X |
| 3,757,848 | 9/1973 | Scholz et al. | 164/282 |
| 3,776,298 | 12/1973 | Vost | 164/282 X |
| 3,812,900 | 5/1974 | Bollig et al. | 164/282 X |
| 3,946,798 | 3/1976 | Uchimoto et al. | 164/282 |

FOREIGN PATENT DOCUMENTS

| | | | |
|---|---|---|---|
| 1,241,918 | 8/1971 | United Kingdom | 164/282 |

*Primary Examiner*—Francis S. Husar
*Assistant Examiner*—K. Y. Lin
*Attorney, Agent, or Firm*—Brumbaugh, Graves, Donohue & Raymond

[57] ABSTRACT

A method of and arrangement for guiding a cast strand that is extracted from the mould has pairs of driving rollers and pairs of supporting rollers arranged alternatingly along the portion where the strand is horizontally guided. Form locking connections are provided for the supporting rollers that are arranged opposite each other. These connections can be released for freeing the upper supporting rollers from load so that they can be lifted away from the strand.

6 Claims, 4 Drawing Figures

METHOD OF GUIDING A CAST STRAND AND ARRANGEMENT FOR CARRYING OUT THE METHOD

BACKGROUND OF THE INVENTION

The invention relates to a method and apparatus for guiding a cast strand that is extracted from a mould and deflected into a horizontal path while its core is still liquid, by using pairs of driving rollers that are adjustable to the strand surface by pressure and by using pairs of supporting rollers whose distance apart is form-lockably adjustable.

When rapidly casting strands in continuous casting plants, a long liquid core results in the strand in dependence upon the high casting capacity, so that the guiding path supporting the strand skin must be of sufficiently great length so that the ferrostatic pressure present in the liquid core can be accommodated. Therefore, it is necessary to guide the cast strand also in the horizontal direction by pairs of supporting rollers that counteract any a bulging of the strand.

In individual cases it is also necessary to cast slowly in such rapid casting plants. This gives rise to problems, since, due to the great length of the machine which often exceeds 30 m, a lot of heat is abducted from the strand, in particular by the cooled supporting rollers arranged in the horizontal part of the guiding path. The strength of the strand increases progressively with decreasing temperatures and there is the danger that the supporting rollers will be damaged by the thoroughly solidified strand. In particular, the supporting rollers can easily be damaged by the end of the cast strand, which end is always supercooled.

It is known to install overload protection means in the form of springs or hydraulic elements in the strand guide, which allow for a swinging out of the supporting rollers in case of overload. However, when casting with high casting speeds it is very important to adjust exactly the supporting rollers that support the incompletely solidified strand, to the thickness of the cast strand, to align them precisely and to keep them in that position during the entire casting procedure in order to obtain a high quality of the strand. Resilient bearings for the supporting rollers do not meet these requirements. It is a further disadvantage that for obtaining effective overload protection the supporting rollers can be mounted only individually or at most in pairs. This requires the aligning of a very great number of supporting roller bearings against one another. This aligning of that very great number of supporting roller bearings not only causes a loss of time when the plant is adjusted to a different strand size, but is also one of the possible reasons for the increased occurrence of the misalignment of neighbouring supporting rollers.

SUMMARY OF THE INVENTION

The present invention aims at preventing the above described disadvantages and difficulties of the hitherto used manners of extraction and strand guides, and has as its object the creation of a method and an apparatus for carrying out the method, which makes it possible in rapid casting plants it is also possible to cast slowly without damage to the supporting rollers, to substantially increase the service life of the supporting rollers and to produce a uniformly high quality of strand for rapidly and slowly cast strands alike.

In a method of the above-defined kind this object is achieved in that form-locking connections of the pairs of supporting rollers (i.e., a connection in which parts are positively held in position relative to one another, as opposed to a sliding or friction connection) are released on the horizontal guiding path from that area in which the strand has solidified throughout to the end of the guiding path. Therefore, only the lower side of the strand is supported, while the driving rollers remain engaged on both sides of the strand. In strands cast with a maximum casting speed, the sump tip will lie at the end of the horizontal part of the guiding path, while in more slowly cast strands the liquid core will only extend over part of the horizontal guiding path. In this case the supporting rollers following the sump tip in the direction of extraction are not form-lockingly adjusted to the strand and thus can no longer be damaged by the solidified strand.

It is suitable to let the upper supporting rollers rest on the surface of the strand after the form-locking connections have been opened or to move them upwardly away from the strand surface. The resting of the upper supporting rollers on the strand proves to be especially advantageous when cooled supporting rollers are used, since this assures a completely uniform cooling of the upper and lower sides of the strand. It is also the object of the present invention to provide an apparatus for carrying out the method with pairs of driving rollers that are adjustable under pressure to the surface of the strand, and with pairs of supporting rollers whose roller distance is form-lockingly adjustable on the horizontal guiding path, drive roller stands, each having two pairs of driving rollers, and supporting roller stands, each having at least five pairs of supporting rollers, are arranged alternatingly. The form-locking connecting means, preferably designed as drawing anchors of the supporting rollers lying opposite each other, are detachable for freeing the upper supporting rollers from the load and the upper supporting rollers can be lifted from the strand surface. By arranging at least five pairs of supporting rollers for each supporting roller stand a high guiding precision is obtained, since a small number of supporting roller stands will be sufficient.

BRIEF DESCRIPTION OF THE DRAWINGS

The invention shall now be described in more detail and with reference to the accompanying drawings, wherein.

DESCRIPTION OF A PREFERRED EMBODIMENT

Figure 4:
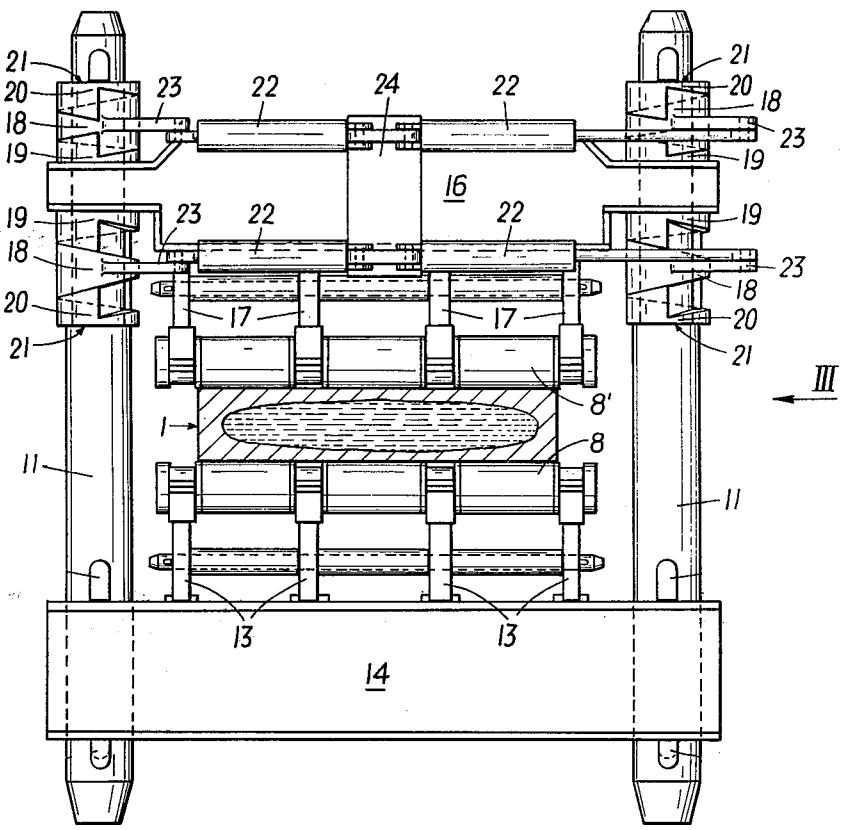
FIGS. 3 and 4 show the details of enlarged side and end views, respectively, of the supporting roller stands of FIGS. 1 and 2.
Figure 3:
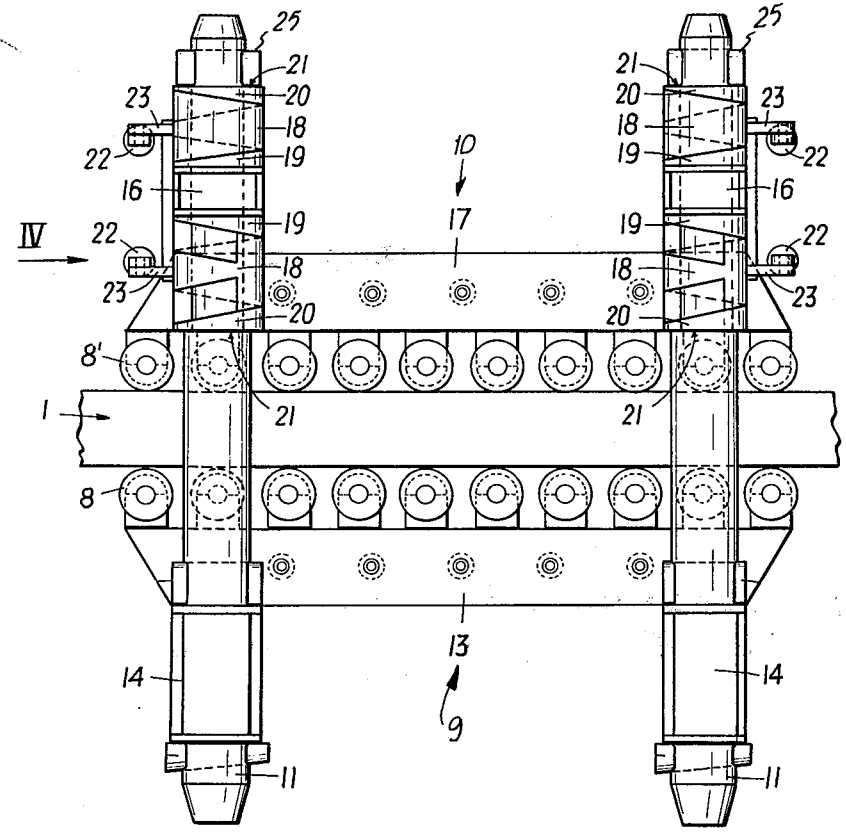

A cast strand 1 is extracted from a mould 2 and its liquid core 3 reaches into the horizontal section of the guiding path following the mould and ends in a sump tip 4. The guiding path is only shown in its horizontal portion, while the bow or curved vertical section of the strand guide is not depicted. The latter is designed in a known manner and has supporting rollers and, if desired, drive rollers. In the horizontal guiding path, driving roller stands 5 having two pairs of driven rollers, comprising rollers 6 and6' each, and supporting roller stands 7 having at least five non-driven pairs of supporting rollers, comprising supporting rollers 8 and 8′ each, are arranged alternatingly. The driven rollers 6 allocated to the lower side of the strand are stationarily mounted, while the driving rollers 6′ allocated to the upper side of the strand are hydraulically adjustable to the strand and thus apply the extraction force to the strand. The supporting rollers 8 for supporting the lower side of the strand are mounted in the lower parts 9 of the supporting roller stands arranged on the base. The lower parts are comprised of longitudinal carriers 13, transverse carriers 14 and roller bearings. Opposite these stationary lower parts 9 are upper parts 10 of the supporting roller stands, upper parts which include transverse carriers 16 and longitudinal carriers 17 that carry the supporting rollers 8′ allocated to the upper side of the strand. Each upper part 10 is movable along tie rods or drawing anchors 11 secured to the lower part 9 and is fixable at various distances, along the drawing anchor by clamping means 12, so that the distance of each upper form-locking supporting roller set, comprising the upper part 10 and the supporting rollers 8′ relative to the opposite lower supporting roller set is adjustable and fixable to a certain extent. One apparatus for moving the upper part along the drawing anchors and clamping it in place is shown in FIGS. 3 and 4. With that clamping device the transverse carriers 16 have bushings 19 fixed to their top and bottom surfaces at the location of drawing anchors 11. These bushings 19 have respective helical faces of opposite slope. In contact with bushings 19 are two bushings 18 that are rotatable and have counter sliding faces corresponding to those of the bushings 19 on one of their ends. Sliding faces of opposite ascent are located on the other of the ends of bushings 18. These other ends of the rotatable bushings 18 are against bushings 20 which are fixed to the drawing anchors and have helical sliding faces matching the ends of the bushings 18 in contact with them. The rotatable bushings 18 are actuated by pressure medium cylinders 22 which are located on a console 24 of carrier 16 and contact projections 23 on the bushings. With this arrangement the cylinders 22 cause a rotation of bushings 18 that clamps the carriers 16 on the drawing anchors. If the ascent of the helical faces is smaller than the angle of friction, the carriers 16 are form-lockably (i.e. positively) secured to the drawing anchors even when the pressure in the cylinders is released. If the wedges 25 adjacent surfaces 21 of the bushings 20 are removed and the piston cylinders activated, the carriers are unclamped. They can then be moved by additional piston cylinders (not shown) or, to a lesser extent, by rotation of the lower of the bushings 18.

Figure 1:
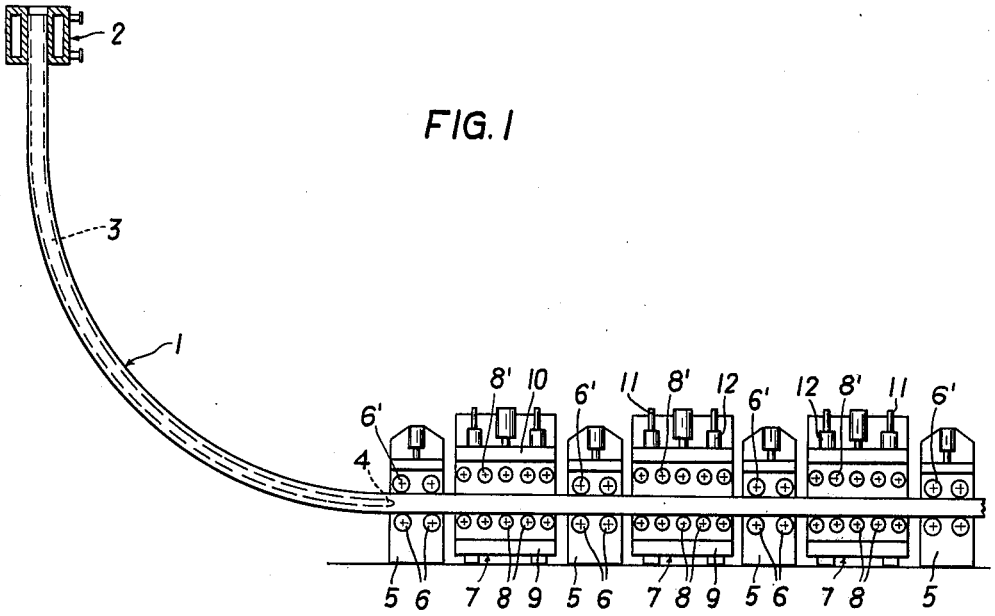
FIG. 1 shows a plant according to the invention during a casting operation at minimum casting speed.

FIG. 1 shows the plant according to the invention, when casting with the lowest speed possible for that plant. Here the liquid core of the strand reaches just to the beginning of the horizontal part of the strand guide. The upper supporting roller sets following the tip of the sump in the extraction direction of the strand are free from load, i.e. a positive or form-locking connection of the upper sets of supporting rollers with the strand has been released and the upper supporting roller sets have been lifted from the strand surface, e.g. by means of pressure medium cylinders. Then only the strand's weight rests on the lower supporting rollers 8, and thus any damage to the supporting rollers 8 and 8′ by the strand is prevented. It is advantageous not to lift the upper supporting roller sets from the strand, in particular when the supporting rollers 8 and 8′ are cooled, but just to release the clamping means 12 and to let the upper supporting roller sets rest on the strand with their own weight, so that the strand is uniformly cooled from the lower side as well as from the upper side. The driving rollers 6 and 6′ remain in engagement with the strand in both cases. They are protected against overload because they are hydraulically adjustable.

Figure 2:
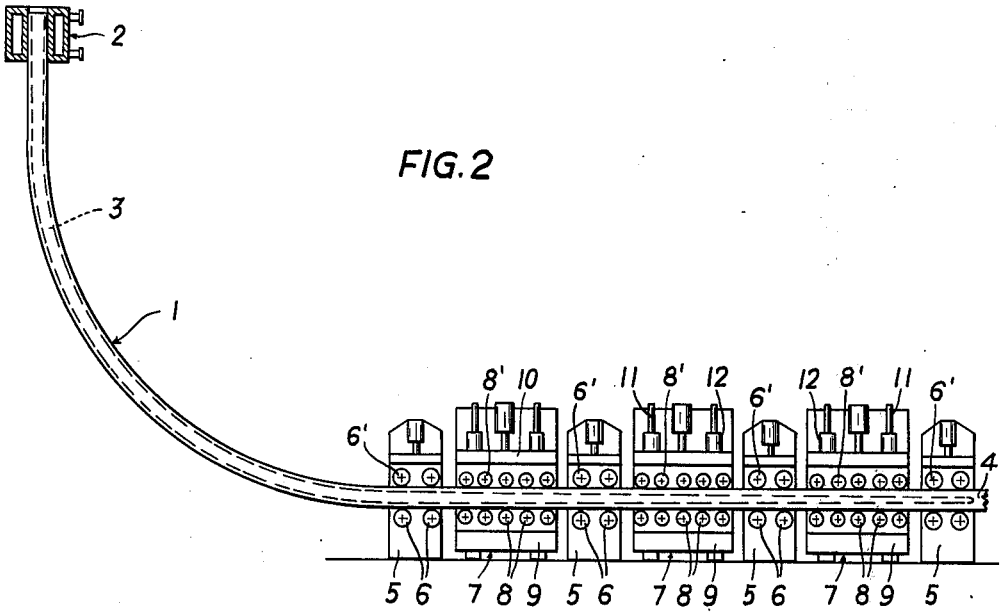
FIG. 2 shows a like plant during a casting operation at maximum casting speed, both in schematic form.

According to FIG. 2, which shows the same plant when casting with the highest permissible casting speed, the liquid core reaches to the end of the horizontal portion of the strand guide. Along the whole horizontal portion of the strand guide the upper supporting roller sets are form-lockingly connected with the lower supporting roller sets.

I claim:

1. In a method of guiding a cast strand which is extracted from a mold and is horizontally deflected toward a horizontal guiding path when still having a liquid core by using pairs of opposing driving rollers that are pressure-adjustable to the surface of the strand and by using pairs of opposing supporting rollers having a distance therebetween that is adjustable by form-locking connection means, the improvement comprising the step of releasing the form-locking connection means between the pairs of supporting rollers from a place in the horizontal guiding path where the strand has entirely solidified to the end of said guiding path so that the strand is only supported by the supporting rollers on its lower side while the pairs of driving rollers remain in engagement on both sides of the strand.

2. A method as set forth in claim 1, wherein the supporting rollers allocated to the upper side of the strand are allowed to rest thereon after releasing the form-locking connection means.

3. A method as set forth in claim 1, wherein the supporting rollers allocated to the upper side of the strand are upwardly moved away from the surface of the strand after releasing the form-locking connection means.

4. An arrangement for guiding a cast strand extracted from a mould and horizontally deflected toward a horizontal guiding path while still having a liquid core, comprising driving roller stands located along said horizontal guiding path and having two pairs of opposing driving rollers each, said driving roller stands being adjustable to the surface of the strand under pressure;

supporting roller stands in alternating arrangement with said driving roller stands along said horizontal guiding path and having at least five pairs of opposing upper and lower supporting rollers each, which rollers support the upper and lower sides of the strand, respectively; and adjustable form-locking connection means for establishing the distance between said upper and lower supporting rollers said connection means being releasable for freeing from load the upper supporting rollers.

5. An arrangement as set forth in claim 4, wherein the supporting rollers allocated to the upper side of the strand are liftable away from the surface of the strand.

6. An arrangement as set forth in claim 4, wherein the form-locking connection means are designed as drawing anchors with clamping means.

* * * * *

UNITED STATES PATENT OFFICE

CERTIFICATE OF CORRECTION

Patent No. 4,122,888 Dated Oct. 31, 1978

Inventor(s) Othmar Pühringer

It is certified that error appears in the above-identified patent and that said Letters Patent are hereby corrected as shown below:

Col. 1, line 22, after "any" delete "a";
line 30, "temperatures" should read --temperature--;
line 40, after "rollers" insert a comma;
line 64, delete "it is also possible".

Col. 2, line 31, "adjustable on" should read --adjustable. On--

Col. 3, line 14, "upper parts which" should read --which upper parts--;
line 20, after "by" insert --form-locking--; and
line 21, delete "form-locking".

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*